US006026742A

United States Patent [19]

Bei

[11] Patent Number: 6,026,742

[45] Date of Patent: Feb. 22, 2000

[54] PRESS FOR PROCESSING AND RECOVERING PRESELECTED SOLID URBAN WASTE AND THE LIKE

[76] Inventor: Antonio Bei, Via della Piaggiola, 101, 06024 Gubbio (Perugia), Italy

[21] Appl. No.: 09/090,699

[22] Filed: Jun. 5, 1998

[30] Foreign Application Priority Data

Apr. 6, 1998 [IT] Italy ..... MI98A0731

[51] Int. Cl.[7] ..... B30B 15/34; B30B 15/08; B30B 9/28

[52] U.S. Cl. ..... 100/318; 83/169; 83/171; 83/858; 100/98 R; 100/188 R; 100/269.14

[58] Field of Search ..... 100/94–98 R, 100/240, 245, 49, 318, 320, 188 R, 269.06, 269.14, 249; 83/98, 169, 171, 177, 858

[56] References Cited

U.S. PATENT DOCUMENTS

| | | | |
|---|---|---|---|
| 276,326 | 4/1883 | Atkiss | 100/98 R |
| 810,998 | 1/1906 | Thomas | 100/98 R |
| 2,916,986 | 12/1959 | Lebovitz | 100/94 |
| 3,576,161 | 4/1971 | Wright | 100/269.06 |
| 3,762,311 | 10/1973 | Friedman et al. | 100/49 |

FOREIGN PATENT DOCUMENTS

| | | | |
|---|---|---|---|
| 2366929 | 5/1978 | France | 100/318 |
| 3-159707 | 7/1991 | Japan | 100/240 |

*Primary Examiner*—Stephen F. Gerrity
*Attorney, Agent, or Firm*—Hedman, Gibson & Costigan, P.C.

[57] ABSTRACT

A press for processing and recovering preselected solid urban waste and the like comprises a hopper which is operatively coupled to a pressing device for reducing the volume of the waste which, in a pressed condition, is conveyed by the pressing device to a cutting device designed for forming the waste into preset cross-section rods.

5 Claims, 4 Drawing Sheets

PRESS FOR PROCESSING AND RECOVERING PRESELECTED SOLID URBAN WASTE AND THE LIKE

BACKGROUND OF THE INVENTION

The present invention relates to a press for processing and recovering preselected solid urban waste and the like.

As is known, a very important problem in Italy and all of the industrialized countries is that of efficiently disposing of urban solid waste or refuse and the like.

A first step for solving the above mentioned problem has been that of collecting in a differentiated manner the solid waste: however, because of the very great amount of waste to be processed, great difficulties are encountered in properly disposing of the waste.

Apparatus and/or systems have been specifically designed for properly disposing of given types of refuse, the designed apparatus and systems providing for use of several types of presses.

The mentioned prior apparatus and systems, however, have the disadvantage that they do not provide a processed waste product which can be efficiently burned to be easily recycled.

SUMMARY OF THE INVENTION

Accordingly, the aim of the present invention is to overcome the above mentioned drawbacks of the prior art.

More specifically, a main object of the present invention is to provide a press for processing preselected solid urban waste, which efficiently operates to reduce the volume of plastic and paper refuse, which press is very simple construction-wise and is adapted to provide an end product which can be easily recovered or recycled by burning it, while allowing the waste or refuse products to be advantageously reused.

To achieve the above mentioned aim and object, as well as yet other objects, which will become more apparent hereinafter, the invention provides an improved press for processing preselected solid urban waste or refuse, said press comprising a hopper, which is operatively coupled to pressing means, for reducing the volume of said waste or refuse.

The pressed waste, in particular, is driven by said pressing means toward suitable cutting means, for cutting said pressed refuse into rods or bars having a preset cross-section.

The press for processing preselected urban solid waste according to the invention is characterized in that said press has the features of claim 1.

The press according to the invention provides the following advantages.

The pre-selected waste, usually together with paper and plastic materials, are efficiently pressed owing to a very rational designing of the press, which has been specifically studied for performing the desired refuse pressing operations.

At the outlet of the press is obtained a pressed waste or refuse product which can be easily recovered by burning it, without any problems.

Moreover, the heat of the burning waste products can be used, for example, as a heat source for heating systems, thereby allowing a great saving in the consumption of conventional types of combustible or fuel materials.

The press according to the present invention, as stated, is very simple construction-wise, thereby it can be easily used and serviced, by the press operators, and, moreover, the operation cost thereof is very small, also due to the above mentioned energy recovery which can be obtained from the outlet recycled waste or refuse products.

BRIEF DESCRIPTION OF THE DRAWINGS

Further characteristics, advantages and constructional details of the press for processing preselected urban solid waste or refuse, according to the present invention, will become more apparent hereinafter from the following detailed disclosure of the accompanying drawings, in which is shown, by way of an indicative, but not limitative example, a preferred embodiment of the subject press.

In the drawings.

DESCRIPTION OF THE PREFERRED EMBODIMENT

Figure 1:
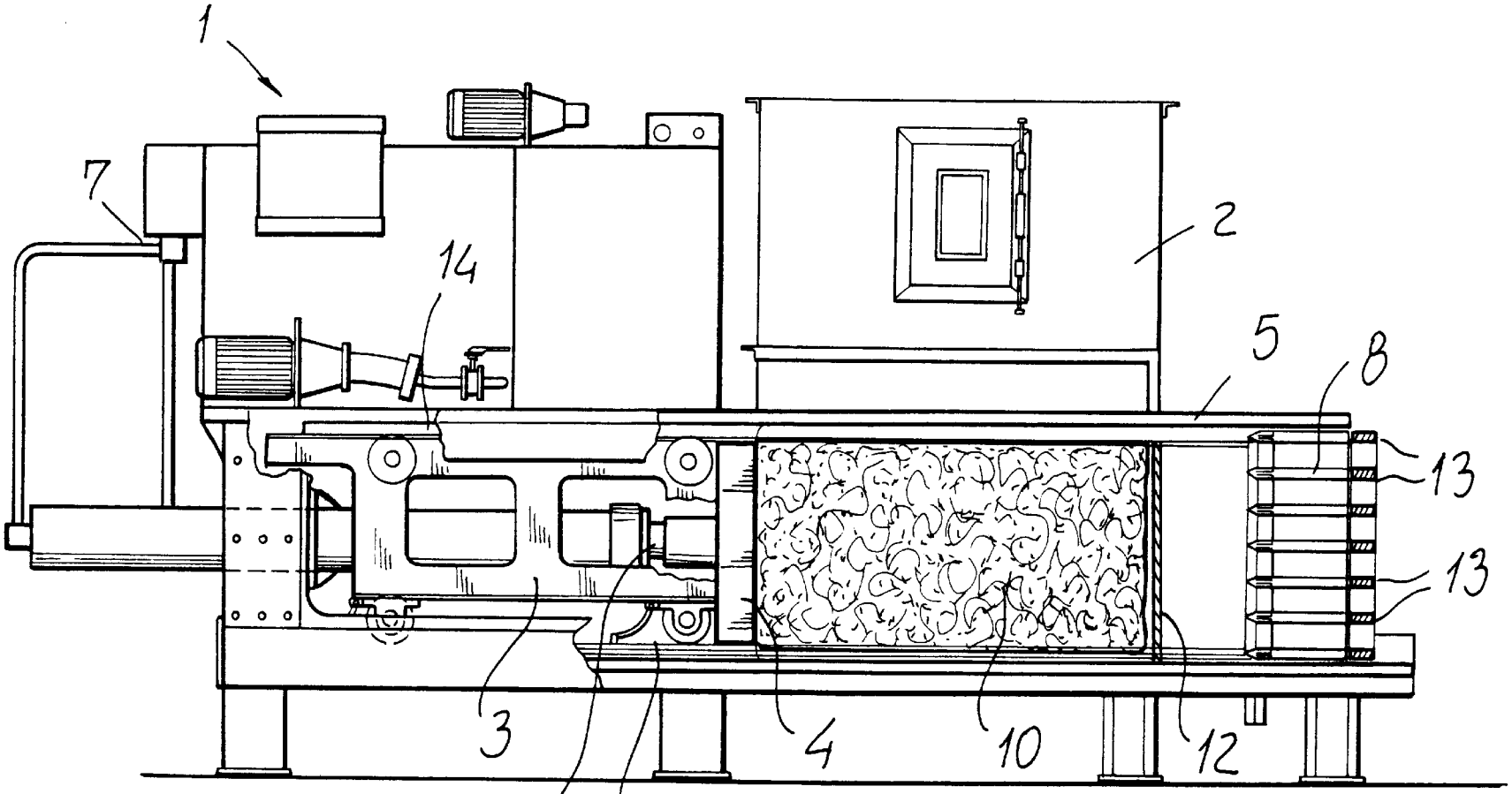
FIG. 1 is a partially cross-sectioned side view of the inventive press during an operating step thereof.
Figure 2:
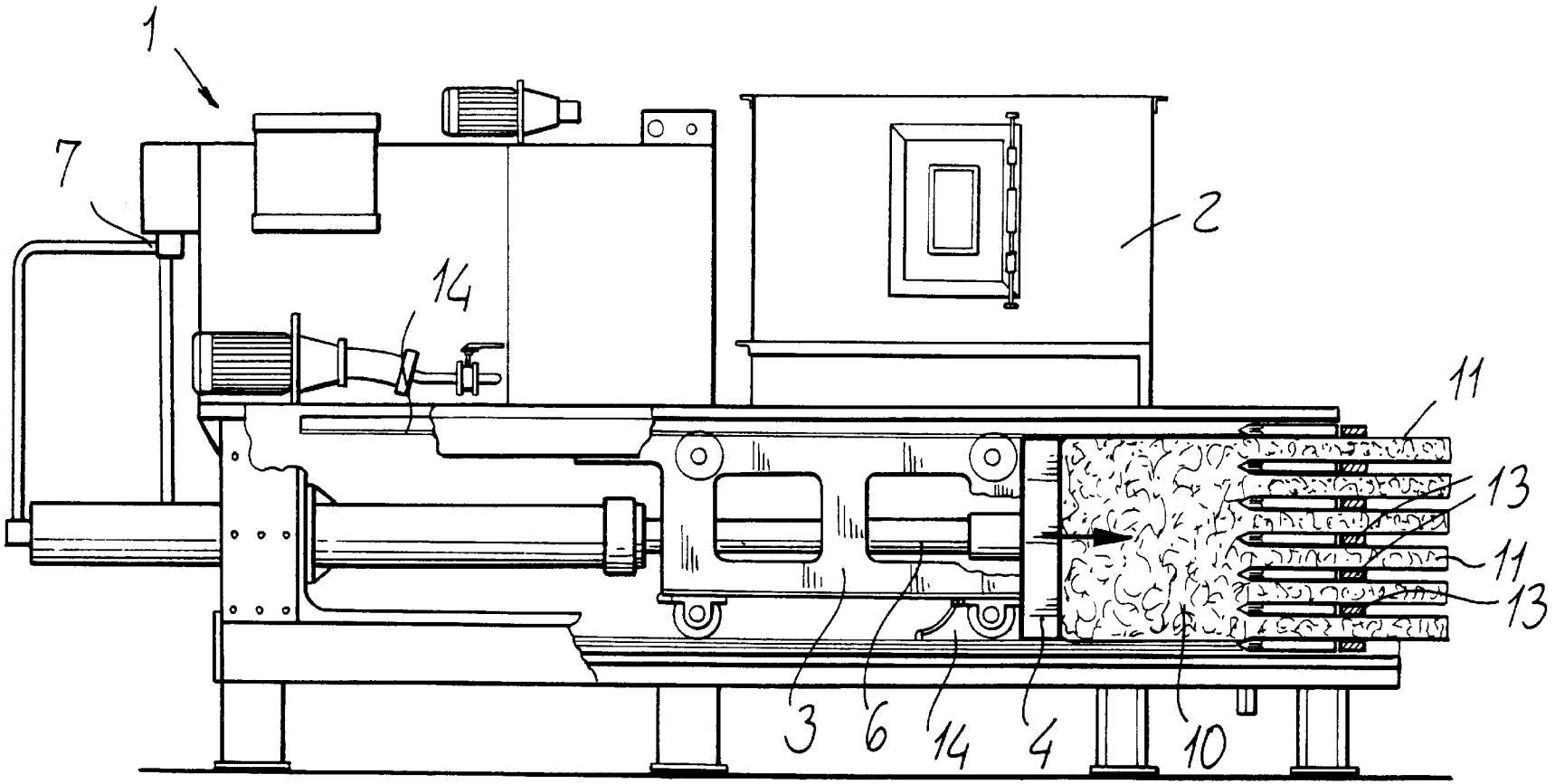
FIG. 2 is a partially cross-sectioned side view of the press shown in FIG. 1 during another operating step thereof.
Figure 3:
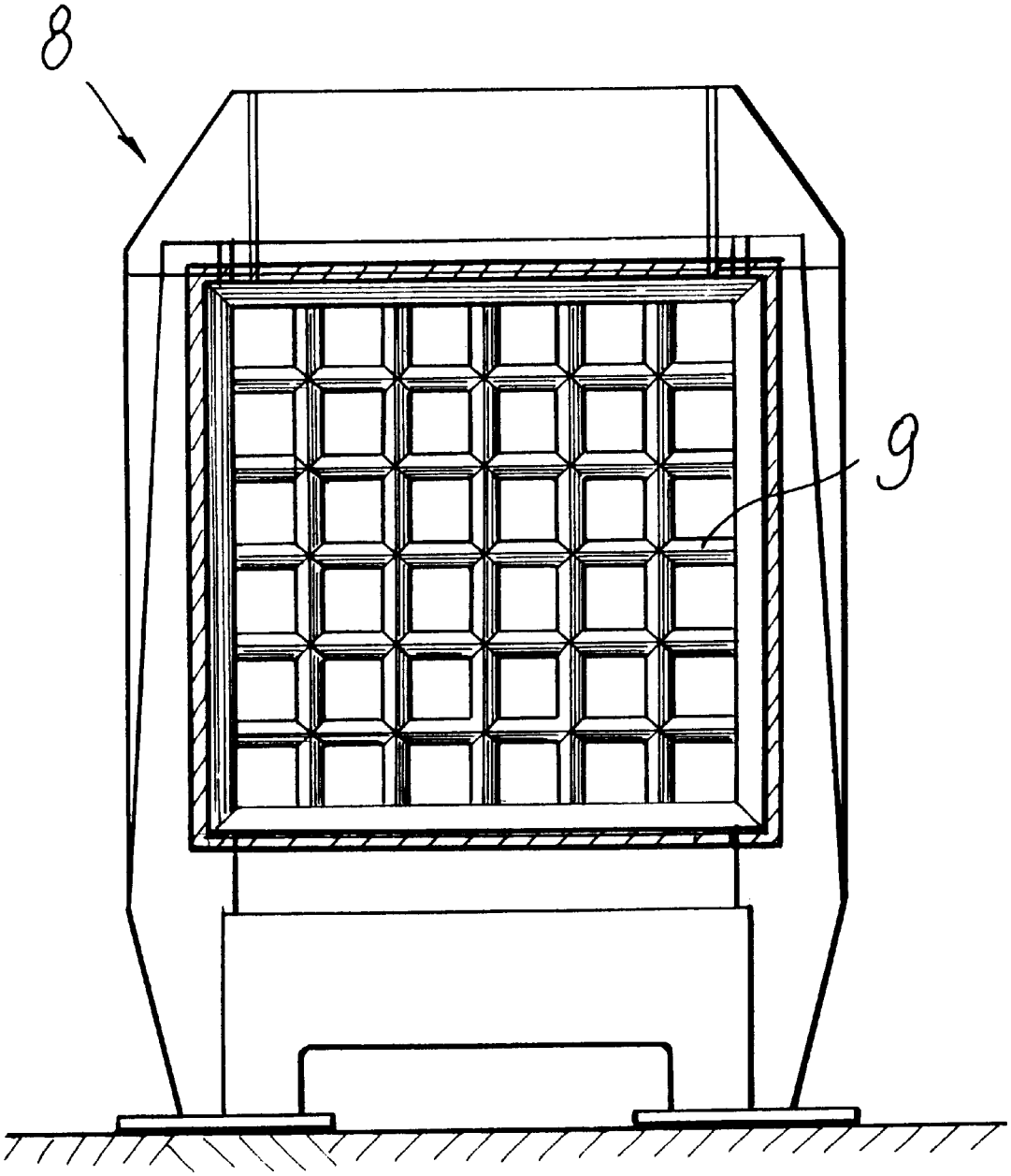
FIG. 3 is a front view of the cutting means assembly included in the improved press according to the invention.
Figure 4:
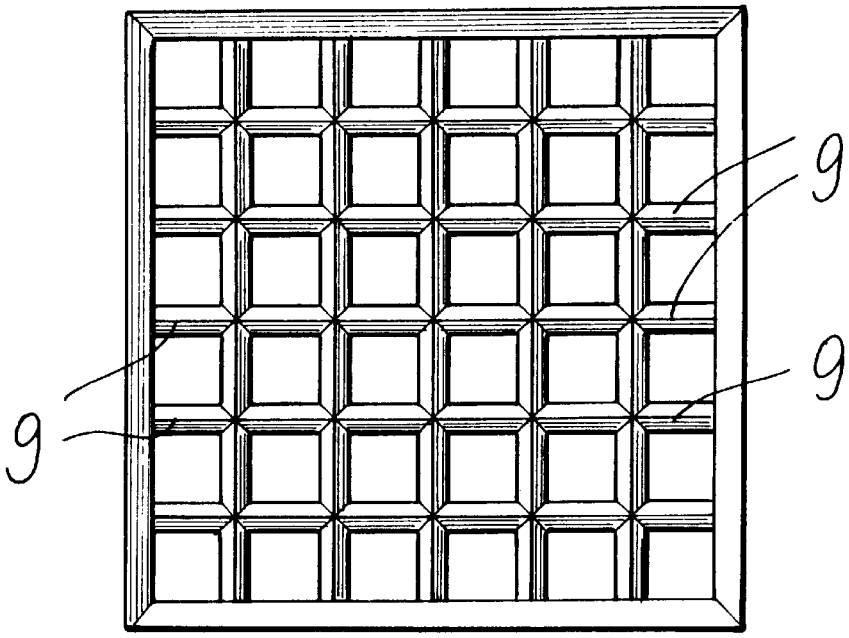
FIG. 4 is a further front view of the mentioned cutting means.
Figure 5:
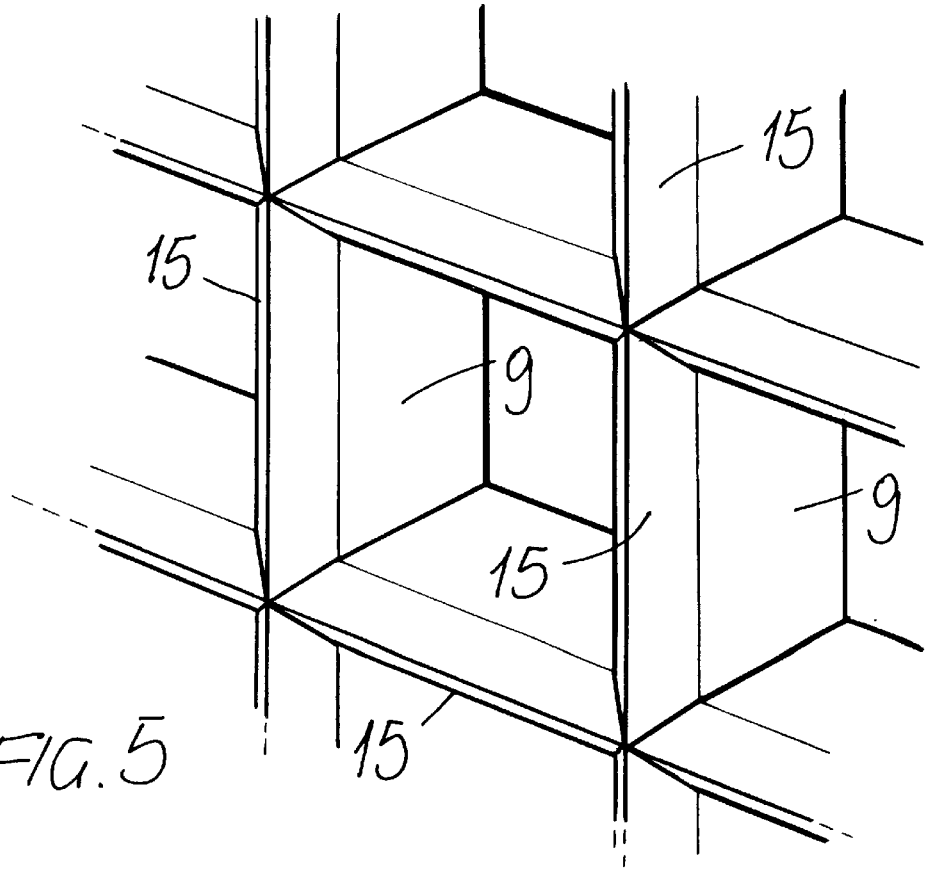
FIG. 5 is a perspective view, on an enlarged scale, of a detail of the mentioned cutting means.

With reference to the reference numerals of the figures of the accompanying drawings, the press 1 for processing preselected urban solid waste or refuse according to the present invention, comprises a press cylinder 5 inside of which is provided a movable piston 4, which is driven, through a piston rod 6, by a hydraulic system 7, operatively coupled to a driving electric system, not shown.

The preselected waste or refuse comprise paper in a rate from 10% to 40%, preferably 25%, and plastic materials in a rate from 60; to 90%, preferably 75%.

The mentioned hydraulic system 7 comprises, advantageously, a plurality of logic elements, replacing the conventional electrovalves, thereby allowing to provide a very rational and functional system which, moreover, is very compact and reliable.

Advantageously, said system comprises two pumps for operating the press 1 according to the invention, even in the case of a possible malfunction of one of said pumps.

Preferably, furthermore, on the hydraulic central unit of said press 1 holding herein the above mentioned logic elements or switches, a pressure switch, not shown, is provided, for allowing to adjust the speed of the press carriage 3, as the pressure on the waste being processed changes.

More specifically, the piston 4 is operatively coupled to said movable press carriage 3 which can slide on suitable rails 14 provided inside the press cylinder 5, so as to substantially contact or not the mentioned piston 4, by adjusting the displacement speed of the latter.

A hopper 2, arranged at the inlet of the preselected waste or refuse, communicates with the inside of the press cylinder 5.

In said hopper a photocell assembly, not shown, is provided, for preventing an overflow condition of said hopper during the loading operation thereof, whereas a second photocell assembly detects the time at which the waste or refuse material inside said cylinder 5 achieves a sufficient amount to start the pressing and volume reducing operations.

A removable bulkhead 12 allows, in opposition to the carriage 3 and to the piston 4 coupled to said carriage, to carry out the waste volume reducing step, thereby providing a block 10 of pressed waste or refuse.

A grid-like blade assembly 8 is arranged near the unloading region provided for the mentioned waste block 10.

Said blade assembly comprises a plurality of blades or knives 9, which are advantageously arranged to form a right angle to one another, the cutting edge 15 of said blades being suitably oriented transversely of the block 10 feeding direction.

At the rear of said blade assembly 8, an assembly of electrical resistances 13, coupled to the mentioned electric system, operates on said blade 8 assembly, to bring it, as the press 1 operates, to a maximum temperature of 440° C.

In this connection it should be apparent that the shapes and size of the elements constituting the press according to the present invention can be varied, depending on requirements, without departing from the scope of the invention.

The operation of the press 1 should be apparent from the previous disclosure.

In particular, the material to be processed, including portions of urban solid waste or refuse, in the above mentioned rates, is fed into the hopper 2 of the press 1.

The two above mentioned photocell assemblies will adjust or control the operation of the press 1.

More specifically, as the amount of waste supplied into the cylinder 5 by the hopper 2 achieves a value suitable for starting the pressing operations, the photocell assembly arranged near the separation region between the press cylinder 5 and hopper 2, will drive the press carriage 3, coupled to said piston 4, with a high speed.

As a pressure suitable for continuing the pressing operation is achieved, the pressure switch provided on the hydraulic central unit of the press 1 will drive the carriage 3 to displace it with a less speed in order to efficiently continue the mentioned pressing operation.

Simultaneously with the starting of the pressing operations, the other photocell assembly provided inside said hopper 2 will shut off the refuse supply to the press 1, thereby preventing possible cloggings of said press.

At the end of the pressing step, the bulkhead 12 is removed.

The waste or refuse material, formed into a waste or refuse block 10 will be driven by the same pressing means, i.e. by the carriage 3 and piston 4, along the remaining portion of the press cylinder 5, so as to contact the blade assembly 8.

The latter, over-heated by the electric resistances 13, will split, in cooperation with said piston 4 and carriage 3, said waste or refuse block 10 into a plurality of rods 11, homogeneous and solid, under the amalgamation effect provided by the partially fused plastic material.

In particular, the bars or rods 11 can be cut into individual portions or "bricks ", which can be used as a combustible material.

In the case of a particularly hard material hindering a proper feeding of the carriage 3 during the cutting operation, then the pressure switch will drive the carriage 3 to move rearwardly, and then it will cause said carriage to restart with a maximum available pressure, using it as a ram member, up to the end of the cutting operation.

Finally, as the blades 9 become dull, then it will not be necessary to disassemble said blades, but it will be sufficient to process said blades by a flexible sharpening element in order to perfectly sharpen said blades, since the cutting edge of said blades 9 is advantageously made of a very hard material such as STELLITE®.

Actually, if the cutting edge of said blades is broken, it will be sufficient to apply the STELLITE® material, by welding, and then sharpen the newly applied STELLITE® material by the mentioned flexible sharpening tool.

I claim:

1. A press for processing and recovering waste, comprising a hopper operatively coupled to pressing means for reducing the volume of the waste and for feeding said waste, in a pressed condition, toward cutting means for cutting said pressed waste into preset cross section bars, said cutting means comprising a grid-like blade assembly including a plurality of knives arranged at a right angle with respect to one another and having a cutting edge transverse to the feeding direction of said pressing means, said blades being coupled to a plurality of electric resistances for improving the transforming of a waste block made by pressing into a plurality of bars to be used as a combustible material.

2. A press according to claim 1, characterized in that said pressing means comprise a cylinder in which are provided a movable piston and a carriage sliding on rails, said piston and carriage being operatively coupled, in order to press said waste in cooperation with an abutment removable bulkhead arranged in said cylinder.

3. A press according to claim 2, characterized in that said piston is driven by a piston rod in turn driven by an electrically controlled hydraulic system.

4. A press according to claim 3, characterized in that said hydraulic system comprises at least two pumps, each said pump being suitable for operating said press.

5. A press for processing and recovering waste, comprising a hopper operatively coupled to a pressing device for reducing the volume of the waste and for feeding said waste, in a pressed condition, toward a cutting device for cutting said pressed waste into preset cross-section bars, said cutting device comprising a grid-like blade assembly including a plurality of knives arranged at a right angle with respect to one another and having a cutting edge transverse to the feeding direction of said pressing device, said blades being coupled to an electric resistance device for improving the transforming of a waste block made by pressing into a plurality of bars.

* * * * *